United States Patent [19]

Teichmann et al.

[11] 4,347,107

[45] Aug. 31, 1982

[54] ELECTROPLATING TIN AND TIN ALLOYS AND BATHS THEREFOR

[75] Inventors: Robert J. Teichmann, Belleville; Linda J. Mayer, Denville, both of N.J.

[73] Assignee: Hooker Chemicals & Plastics Corp., Warren, Mich.

[21] Appl. No.: 250,373

[22] Filed: Apr. 2, 1981

[51] Int. Cl.[3] ..... C25D 3/60

[52] U.S. Cl. ..... 204/44; 204/43 S; 204/54 R

[58] Field of Search ..... 204/43 S, 44, 54 R, 204/120, 123

[56] References Cited

U.S. PATENT DOCUMENTS

| | | | |
|---|---|---|---|
| 3,616,291 | 10/1971 | Wilson | 204/27 |
| 3,749,649 | 7/1973 | Valayil | 204/43 S |
| 3,785,939 | 1/1974 | Hsu | 204/43 S |
| 3,905,878 | 9/1975 | Dohi et al. | 204/43 S |
| 3,926,749 | 12/1975 | Passal | 204/43 S |
| 4,132,610 | 1/1979 | Dohi et al. | 204/43 S |
| 4,135,991 | 1/1979 | Canaris et al. | 204/43 S |

FOREIGN PATENT DOCUMENTS

| | | | |
|---|---|---|---|
| 445708 | 2/1976 | U.S.S.R. | 204/43 S |

*Primary Examiner*—G. L. Kaplan

*Attorney, Agent, or Firm*—Richard P. Mueller; Arthur E. Kluegel

[57] ABSTRACT

Improved electroplating bath for depositing bright, metallic tin wherein divalent tin, in the form of stannous sulfate or fluoroborate, is present in conjunction with sulfuric or fluoroboric acid, brighteners including an aromatic amine and an aliphatic aldehyde, a polyalkylene ether surfactant, and an aromatic sulfonic acid to ensure bath stability as well as the requisite brightness. The divalent tin-containing electroplating bath may also be provided with copper or rhodium salts to achieve codeposition of tin with at least one of these alloying metals. The method of utilizing such divalent tin electroplating baths to plate substrates with bright metallic tin is also described and claimed.

21 Claims, No Drawings

ELECTROPLATING TIN AND TIN ALLOYS AND BATHS THEREFOR

FIELD OF THE INVENTION

The present invention relates to depositing tin as well as copper or rhodium alloys thereof on various substrates; more particularly the invention pertains to depositing of bright, metallic tin from stable baths wherein the tin is in the form of divalent tin sulfate or fluoroborate, i.e. stannous sulfate or fluoroborate.

BACKGROUND OF THE INVENTION

There is a substantial body of prior art patents concerned with tin or tin alloy electroplating baths and processes for utilizing the same. Some of the more relevant patents for the present purposes include U.S. Pat. Nos. 3,730,853 (Sedlacek et al.); 3,749,649 (Valayil); 3,769,182 (Beckwith et al.); 3,785,939 (Hsu); 3,850,765 (Karustis, Jr. et al.); 3,875,029 (Rosenberg et al.); 3,905,878 (Dohi et al.); 3,926,749 (Passal); 3,954,573 (Dahlgren et al.); 3,956,123 (Rosenberg et al.); 3,977,949 (Rosenberg); 4,000,047 (Ostrow et al.); 4,135,991 (Canaris et al.); 4,118,289 (Hsu); and British Pat. Nos. 1,351,875 and 1,408,148.

Despite the existence of this extensive literature and the various formulations which have been suggested for commercial applications, there is still a need for electroplating baths which will effectively deposit bright metallic tin on various substrates. Another important characteristic is bath stability, especially premature tin compound precipitation in the bath. The variety of bath formulations proposed heretofore reveal, moreover, that all of the ingredients employed in the bath formulation must be taken into consideration not only with respect to the type of deposit obtained but also with respect to questions of bath stability, by-product formation, etc.

OBJECTS OF THE INVENTION

One object of the present invention is to provide a tin electroplating bath which ensures the deposition of bright metallic tin on various substrates.

Another object of the present invention is to provide a divalent tin electroplating bath of improved stability.

A further object of the present invention is to provide an improved electroplating bath for the deposition of alloys of tin with copper and rhodium.

These and other objects will become readily apparent from the following description and illustrative embodiments of the present invention.

SUMMARY OF THE INVENTION

In accordance with the present invention it has now been found that by utilizing certain aromatic sulfonic acid additives in conjunction with certain other additives an improved tin electroplating bath, formulated with bath soluble divalent tin compounds, can be achieved. The resulting bath will not only lead to the deposition of bright metallic tin but will be further characterized by outstanding stability.

The other bath ingredients will comprise an inorganic acid, an aromatic amine brightener, and a nonionic surface active agent. Preferably, the bath will also contain an aliphatic aldehyde brightener.

In accordance with another aspect of the present invention copper or rhodium metals may be effectively co-deposited with the tin from the electroplating baths.

DETAILED DESCRIPTION OF THE INVENTION

The electroplating baths of this invention are formulated with divalent tin in the form of a bath soluble compound. Typical of such compounds are stannous sulfate, stannous fluoroborate and stannous chloride. Free inorganic acid is also present in amounts sufficient to provide conductivity, maintain bath pH below 2.0 and maintain the solubility of metal salts. It will be understood that the particular acid used will correspond to the anion of divalent tin compound, e.g. sulfuric acid, fluoroboric acid, hydrochloric acid or the like.

The brightener system will comprise one or more aromatic amines and, most preferably will comprise a combination of one or more aromatic amines and aliphatic aldehydes. The aromatic or aryl amines useful for the present purposes include o-toluidine; p-toluidine; m-toluidine; aniline; and o-chloroaniline. For most purposes the use of o-chloroaniline is especially preferred.

Suitable aliphatic aldehydes are those containing from 1 to 4 carbon atoms and include, for example, formaldehyde, acetaldehyde, propionaldehyde, butyraaldehyde, crotonaldehyde, etc. In this invention the preferred aldehyde is formaldehyde or formalin, a 37% solution of formaldehyde.

Nonionic surfactants are employed in the bath to provide grain refinement of the electrodeposit. These can be commercially available materials such as nonyl phenoxy polyethlene oxide ethanol (Igelpal C0630 and Triton Q515); ethoxylated alkylolamide (Amidex L5 and C3); alkyl phenyl polyglycoletherethylene oxide (Newtronyx 675) and the like.

The nonionic surface active agents which have been found to be particularly effective for the present purposes are the polyoxyalkylene ethers, where the alkylene group contains from 2 to 20 carbon atoms. Polyoxyethylene ethers having from 10 to 20 moles of ethylene oxide per mole of lipophilic groups are preferred, and include such surfactants as polyoxyethylene lauryl ether (sold under the tradename Brij 25-SP).

As previously described, the essential feature of the present invention is to utilize an aromatic sulfonic acid compound in conjunction with the bath ingredients set forth above. These sulfonic acid compounds maintain stability of the plating bath and provide supplemental brightening and grain refinement to the electrodeposit. Preferred aromatic sulfonic acids for these purposes are:

- o-cresol sulfonic acid
- m-cresol sulfonic acid
- phenol sulfonic acid

Other phenol sulfonic acid derivatives of phenol and cresol which could be employed are, for example:

- 2,6-dimethyl phenol sulfonic acid
- 2-chloro, 6-methyl phenol sulfonic acid
- 2,4-dimethyl phenol sulfonic acid
- 2,4,6-trimethyl phenol sulfonic acid
- m-cresol sulfonic acid
- p-cresol sulfonic acid Sulfonic acid derivatives of alpha- and beta-naphthols are also possible candidates for the aromatic sulphonic acid ingredient. Additionally, the bath soluble salts of the above acids, such as the alkali metal salts, may be used instead of or in addition to the acid.

In formulating the plating baths of the present invention, the divalent tin compound will be used in an amount at least sufficient to deposit tin on the substrate to be plated, up to its maximum solubility in the bath. The inorganic acid will be present in an amount sufficient to maintain the pH of the plating bath not in excess of about 2.0. The aromatic amine or the combination of the aromatic amine and the aliphatic aldehyde are present in amounts at least sufficient to impart brightness to the tin electrodeposit, while the nonionic surfactant is present in the bath in a grain refining amount. The aromatic sulfonic acid derivative is present in an amount sufficient to maintain the stability of the plating bath and enhance the brightness of the electrodeposit.

More specifically, the ingredients of the aqueous electroplating baths of this invention will be present in amounts within the following ranges:

| Ingredients | Amounts (grams/liter) Typical | Preferred |
|---|---|---|
| (1) Tin (II), as stannous sulfate, fluoroborate or chloride | 5–50 | 15–30 |
| (2) Sulfuric, fluoroboric or hydrochloric acid | 100–250 | 160–190 |
| (3) Aromatic Amine | 0.3–15 | 0.5–1.5 |
| (4) Aliphatic Aldehyde | 0.5–11 | 0.9–5.4 |
| (5) Nonionic surfactant | 0.1–20 | 0.5–2.5 |
| (6) Aromatic sulfonic acid derivative | 0.5–3.0 | 3–9 |

The pH of the bath will not be in excess of about 2.0 and will usually be less than about 1, with ranges from about 0 to 0.5 being typical and ranges from about 0 to 0.3 being preferred. Electroplating temperatures and current densities used will be those at which there are no adverse effects on either the plating bath or the electrodeposit produced. Typically, the temperatures will be from about 10 degrees to 40 degrees C., with temperatures of about 15 degrees to 25 degrees C. being preferred. Typical current densities will be about 10 to 400 Amps/square foot (ASF) and preferably about 25 to 200 ASF.

The substrates which may be satisfactorily plated utilizing the electroplating baths of this invention include most metallic substrates, except zinc, such as copper, copper alloys, iron, steel, nickel, nickel alloys and the like. Additionally, non-metallic substrates that have been treated to provide sufficient conductivity may also be plated with the bath and process of the present invention.

Another aspect of this invention involves the discovery that copper and rhodium metals can be deposited with tin on the substrates when utilizing the electroplating baths described above without additional additives or complexing agents. In contrast, metals such as nickel, iron and indium did not codeposit under the same conditions.

Typically, the copper or rhodium is added to the bath as bath soluble compounds, preferably having the same anions as the divalent tin compounds. The amounts of such compounds added with be sufficient to provide up to about 5% by weight of copper or rhodium, alloyed with tin, in the electrodeposit. Typical amounts of copper and rhodium in the electroplating baths to provide such quantities of the metal in the electrodeposit are about 0.2 to 4 grams/liter and 0.2 to 2 grams/liter, respectively.

The invention will be more fully understood by reference to the following specific embodiments:

EXAMPLE I

An electroplating bath was prepared from the ingredients set forth below:

| Ingredients | Amount g/l |
|---|---|
| Tin (II), as stannous sulfate | 22.5 |
| Sulfuric Acid | 175 |
| o-chloroaniline | 1.0, cc/l |
| Formalin | 10, cc/l |
| Polyoxyethylene lauryl ether | 1.0 |
| o-Cresol sulfonic acid | 5.0 |
| Water | Remainder |

This resulting stable bath was operated at 20 degrees C., 30 ASF, with rapid agitation to plate a copper panel. The tin deposit thus formed had a very bright appearance.

EXAMPLE II

It has been found that there is a side reaction between formaldehyde and the sulfonic acid which causes a precipitate to form and settle out of the bath solution. However, it was further found that if the ortho position, and to a lesser extent the meta position, of the phenol sulfonic acid are blocked by methyl groups, as in o-cresol sulfonic acid, this undesirable side reaction, and hence the precipitation, slows down. The other ingredients of Example I may also be further optimized (e.g., work load, agitation, etc.) to minimize, if not eliminate this precipitate. Utilizing the other ingredients of Example I, a number of the aromatic sulfonic acids were tested to determine bath stability. The results were as follows:

| Additive | Amount (ml/l) | Stability (hrs) |
|---|---|---|
| o-Cresol sulfonic acid (65%) | 8 | 24 |
| m-Cresol sulfonic acid (33%) | 6 | 16 |
| Phenol sulfonic acid (65%) | 10 | 12 |

EXAMPLE III

An electroplating bath was prepared from the following ingredients:

| Ingredients | Amount (g/l) |
|---|---|
| Tin II, as stannous sulfate | 30 |
| Sulfuric acid | 175 |
| Copper, as copper sulfate | 0.4 |
| Formalin | 10, cc/l |
| o-Chloroaniline | 0.4 cc/l |
| Polyoxyethylene lauryl ether | 0.4 |
| o-Cresol sulfonic acid | 0.8 |

The resulting bath was operated at 60 asf produced a tin/copper alloy deposit containing 1.0% copper, the deposit was semi-bright.

EXAMPLE IV

In the formulation of Example III the copper was replaced with rhodium at a concentration of 0.5 g/l from rhodium sulfate. The bath was operated at 60 asf and produced a very bright tin/rhodium alloy deposit containing 0.07% rhodium.

When nickel, iron or indium metal were employed in the divalent tin baths of this invention, they failed to codeposit with the metallic tin.

EXAMPLE V

To demonstrate the stability enhancing effects achieved by the use of an aromatic sulfonic acid in the tin electroplating baths of this invention the following baths were prepared.

| | g/l |
|---|---|
| BATH A | |
| Stannous sulfate | 60 |
| Sulfuric acid | 180 |
| o-Cresol sulfonic acid | 5.6 |
| Water | Remainder |
| BATH B | |
| Stannous sulfate | 60 |
| Sulfuric acid | 180 |
| Water | Remainder |

An electric air compressor with spargers was employed to pump air at a flow rate of approximately 15 cubic feet per minute through the bath in a 1 liter beaker.

| Time Period | Stannic Tin Conc. (g/l) BATH A | BATH B |
|---|---|---|
| Start | 0.3 | 0.5 |
| 5 days | 2.2 | 9.1 |
| 10 days | 3.5 | 13.6 |

In commercial operations air is normally present as a result of agitation, and becomes a serious problem because high rates of agitation will entrap substantial amounts of air which, in the absence of the aromatic sulfonic acid, will cause formation of stannic tin in the bath which is a measure of bath degradation.

It will be further understood that the foregoing examples are illustrative only, and that variations and modifications may be made without departing from the scope of this invention.

What is claimed is:

1. An aqueous electroplating bath for the deposition of bright metallic tin or alloys of tin with copper or rhodium which comprises a bath soluble divalent tin compound in an amount sufficient to deposit tin on the substrate being plated, an inorganic acid in an amount sufficient to maintain the bath pH not in excess of about 2.0, a brightening amount of an aromatic amine brightener, a nonionic surfactant, and a sufficient amount of an aromatic sulfonic acid to maintain the stability of the plating bath and enhance the brightness of the electrodeposit.

2. The electroplating bath of claim 1, wherein there is also present a brightening amount of an aliphatic aldehyde brightener.

3. The electroplating bath of claim 2, wherein the nonionic surfactant is a polyoxyalkylene ether.

4. The electroplating bath of claim 3, wherein the polyoxyalkylene ether is polyoxyethylene lauryl ether.

5. The electroplating bath of claim 2, wherein said aromatic amine brightener is o-chloroaniline.

6. The electroplating bath of claim 2, wherein said aliphatic aldehyde brightener is formaldehyde.

7. The electroplating bath of claim 2, wherein the aromatic sulfonic acid is selected from the group consisting of cresol and phenol sulfonic acids.

8. The electroplating bath of claim 7, wherein the aromatic sulfonic acid is o-cresol sulfonic acid.

9. The electroplating bath of claim 2, wherein the divalent tin is stannous sulfate and the acid is sulfuric acid.

10. The electroplating bath of claim 2, which also contains an alloying metal selected from the group consisting of copper and rhodium metals.

11. The electroplating bath of claim 10, wherein the alloying metal is in the form of its sulfate salt.

12. An aqueous electroplating bath for the deposition of bright, metallic tin on substrates which comprises the following ingredients in the amounts indicated:

| | Amounts g/l |
|---|---|
| (a) Stannous sulfate or fluoroborate | 5 to 50 |
| (b) Sulfuric or fluoroboric acid | 100 to 250 |
| (c) Aromatic amine brightener | 0.3 to 15 |
| (d) Aliphatic aldehyde brightener | 0.5 to 11 |
| (e) Polyoxyalkylene ether | 0.1 to 20 |
| (f) Cresol or phenol sulfonic acid | 0.5 to 30. |

13. The electroplating bath of claim 12, which also contains an alloying metal ingredient selected from the group consisting of copper sulfate and rhodium sulfate.

14. The electroplating bath of claim 12, wherein ingredient (a) is stannous sulfate.

15. The electroplating bath of claim 12, wherein ingredient (b) is sulfuric acid.

16. The electroplating bath of claim 12, wherein ingredient (c) is o-chloroaniline and ingredient (d) is formaldehyde.

17. The electroplating bath of claim 12, wherein the polyoxyalkylene ether is polyoxyethylene ether.

18. The electroplating bath of claim 12, wherein ingredient (f) is a cresol sulfonic acid.

19. The electroplating bath of claim 18, wherein the cresol sulfonic acid is o-cresol sulfonic acid.

20. An aqueous electroplating bath for the deposition of bright, metallic tin on substrates which comprises the following ingredients:

| | Amounts (g/l) |
|---|---|
| (a) Stannous sulfate | 5 to 50 |
| (b) Sulfuric acid | 100 to 250 |
| (c) o-chloroaniline | 0.3 to 15 |
| (d) formalin | 0.5 to 11 |
| (e) polyoxyethylene lauryl ether | 0.1 to 20 |
| (f) a cresol sulfonic acid | 0.5 to 30. |

21. A method for the deposition of bright metallic tin on a substrate which comprises electroplating said substrate in the plating bath of claim 1, 2, 3, 4, 5, 6, 7, 8, 9, 10, 11, 12, 13, 14, 15, 16, 17, 18, 19 or 20 for a period of time sufficient to form the desired electrodeposit on the substrate.

* * * * *